US009695659B2

(12) United States Patent
Davis et al.

(10) Patent No.: US 9,695,659 B2
(45) Date of Patent: Jul. 4, 2017

(54) PIPE SWELL POWERED TOOL

(71) Applicant: HALLIBURTON ENERGY SERVICES, INC., Houston, TX (US)

(72) Inventors: Glenn Ray Davis, Euless, TX (US); Bruce Edward Scott, McKinney, TX (US); James Dan Vick, Jr., Dallas, TX (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 240 days.

(21) Appl. No.: 14/391,175

(22) PCT Filed: Nov. 11, 2013

(86) PCT No.: PCT/US2013/069402

§ 371 (c)(1),
(2) Date: Oct. 8, 2014

(87) PCT Pub. No.: WO2015/069291

PCT Pub. Date: May 14, 2015

(65) Prior Publication Data

US 2016/0298405 A1 Oct. 13, 2016

(51) Int. Cl.
*E21B 23/04* (2006.01)
*E21B 33/127* (2006.01)
(Continued)

(52) U.S. Cl.
CPC ..... *E21B 23/04* (2013.01); *E21B 33/127* (2013.01); *E21B 34/10* (2013.01); *E21B 2034/005* (2013.01); *E21B 2034/007* (2013.01)

(58) Field of Classification Search
CPC ..... E21B 23/04; E21B 33/127; E21B 34/10; E21B 2034/005; E21B 2034/007
See application file for complete search history.

(56) References Cited

U.S. PATENT DOCUMENTS 4,161,219 A 7/1979 Pringle
4,252,197 A 2/1981 Pringle
(Continued)

FOREIGN PATENT DOCUMENTS

EP 2206878 7/2010
WO 2014126568 8/2014

OTHER PUBLICATIONS

FS Fluid Loss Isolation Barrier Valve, retrieved from the internet at http://www.halliburton.com/public/lp/contents/Data_Sheets/web/H/H06387.pdf, Nov. 2013, 2 pages.
(Continued)

*Primary Examiner* — Brad Harcourt
(74) *Attorney, Agent, or Firm* — Kilpatrick Townsend & Stockton LLP

(57) ABSTRACT

Certain aspects of the present disclosure are directed to tools actuated by pipe swell. A downhole assembly for a wellbore may be provided. The downhole assembly can include a first sleeve and a second sleeve. The first sleeve can expand from a first position to a second position in response to a first pressure applied to the first sleeve. The first sleeve can contract to the first position in response to a cessation of the first pressure. The second sleeve can be positioned adjacent to the first sleeve to define a swell chamber. The swell chamber can actuate a downhole tool by a pressure stored in the swell chamber by the expansion of the first sleeve.

21 Claims, 8 Drawing Sheets

(51) Int. Cl.
*E21B 34/10* (2006.01)
*E21B 34/00* (2006.01)

(56) References Cited

U.S. PATENT DOCUMENTS

| | | | | |
|---|---|---|---|---|
| 4,691,779 | A | 9/1987 | McMahan et al. | |
| 5,560,426 | A | 10/1996 | Trahan et al. | |
| 6,325,148 | B1 | 12/2001 | Trahan et al. | |
| 7,549,480 | B2 | 6/2009 | Lohbeck | |
| 7,552,774 | B2 | 6/2009 | Anderson et al. | |
| 7,591,317 | B2 | 9/2009 | Bane et al. | |
| 7,661,470 | B2 | 2/2010 | Doane et al. | |
| 7,665,518 | B2 | 2/2010 | Bane et al. | |
| 7,694,742 | B2 | 4/2010 | Bane et al. | |
| 7,717,185 | B2 | 5/2010 | Anderson et al. | |
| 7,762,335 | B2 | 7/2010 | Anderson et al. | |
| 7,905,292 | B2 | 3/2011 | Beall et al. | |
| 7,938,179 | B2 | 5/2011 | Bane et al. | |
| 8,196,679 | B2 | 6/2012 | Radford | |
| 2002/0189821 | A1* | 12/2002 | Watson | E21B 33/127 166/387 |
| 2003/0121665 | A1 | 7/2003 | Trott et al. | |
| 2005/0178559 | A1 | 8/2005 | Jacob | |
| 2006/0086509 | A1 | 4/2006 | McMillan et al. | |
| 2008/0066921 | A1 | 3/2008 | Bane et al. | |
| 2008/0078553 | A1 | 4/2008 | George | |
| 2008/0128137 | A1 | 6/2008 | Anderson et al. | |
| 2009/0008078 | A1* | 1/2009 | Patel | E21B 34/10 166/50 |
| 2009/0126936 | A1 | 5/2009 | Begley et al. | |
| 2009/0188662 | A1 | 7/2009 | Casciaro et al. | |
| 2009/0255692 | A1 | 10/2009 | Coronado | |
| 2010/0212891 | A1 | 8/2010 | Stewart et al. | |
| 2010/0294508 | A1 | 11/2010 | Xu et al. | |
| 2012/0211221 | A1 | 8/2012 | Mills et al. | |
| 2015/0369005 | A1 | 12/2015 | Vick, Jr. | |

OTHER PUBLICATIONS

PCT/US2013/069402 , "International Search Report", Aug. 12, 2014, 15 pages.
Depthstar® , Depthstar® Tubing Retrievable Safety Valve, 2008, 4 pages.
NE™, NE™ Tubing-Retrievable Safety Valve, as early as 2011, 2 pages.
SP™, "SP™ Tubing-Retrievable Safety Valves", available publicly as early as 2011, 2 pages.

* cited by examiner

PIPE SWELL POWERED TOOL

CROSS-REFERENCE TO RELATED APPLICATIONS

This is a U.S. national phase under 35 U.S.C. 371 of International Patent Application No. PCT/US2013/069402, titled "Pipe Swell Powered Tool" and filed Nov. 11, 2013, the entirety of which is incorporated herein by reference.

TECHNICAL FIELD OF THE DISCLOSURE

The present disclosure relates generally to devices for use in a wellbore in a subterranean formation and, more particularly (although not necessarily exclusively), to tools powered or actuated by pipe swell.

BACKGROUND

Various devices can be installed in a well traversing a hydrocarbon-bearing subterranean formation. Several devices can be actuated within the well in order to perform specific functions. Prior solutions for actuating devices positioned in a wellbore may include assemblies having multiple components. Such solutions may increase the cost or complexity (or both) of actuating downhole tools.

Simplified mechanisms for actuating downhole tools are desirable.

DETAILED DESCRIPTION

Certain aspects of the present disclosure are directed to tools powered or actuated by pipe swell. A pipe positioned in a wellbore can be used for communicating fluid at a different pressure level from a fluid surrounding the pipe. Modifying the difference between the internal and external pressure can cause the pipe to expand or contract and change the volume of the pipe. A non-expanding barrier can be coupled with the pipe to store pressurized fluid in the changed volume. The stored pressurized fluid can be utilized as a pressure source to actuate downhole tools.

In some aspects, a downhole assembly for a wellbore can utilize expansion of a pipe to actuate a downhole tool. The downhole assembly can include a first sleeve that can expand from a first position to a second position in response to a pressure applied to the first sleeve. The first sleeve can contract to the first position in response to a cessation of the pressure. The assembly can also include a second sleeve adjacent to the first sleeve. The first sleeve and the second sleeve can together define a swell chamber. The second sleeve may be circumferentially aligned with the first sleeve. The second sleeve can expand less than the expansion of the first sleeve in response to the pressure being applied to the second sleeve. The combined expansion of the first and the second sleeve can increase the volume of pressurized fluid stored in the swell chamber between the first and the second sleeves. The swell chamber can actuate a downhole tool via a pressure stored in the swell chamber. The pressure can be stored by the expansion of the first sleeve.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top or left of the corresponding figure and the downward direction being toward the bottom or right of the corresponding figure, the uphole direction being toward the surface of the well and the downhole direction being toward the toe of the well. Like the illustrative aspects, the numerals and directional descriptions included in the following sections should not be used to limit the present disclosure.

Figure 1:
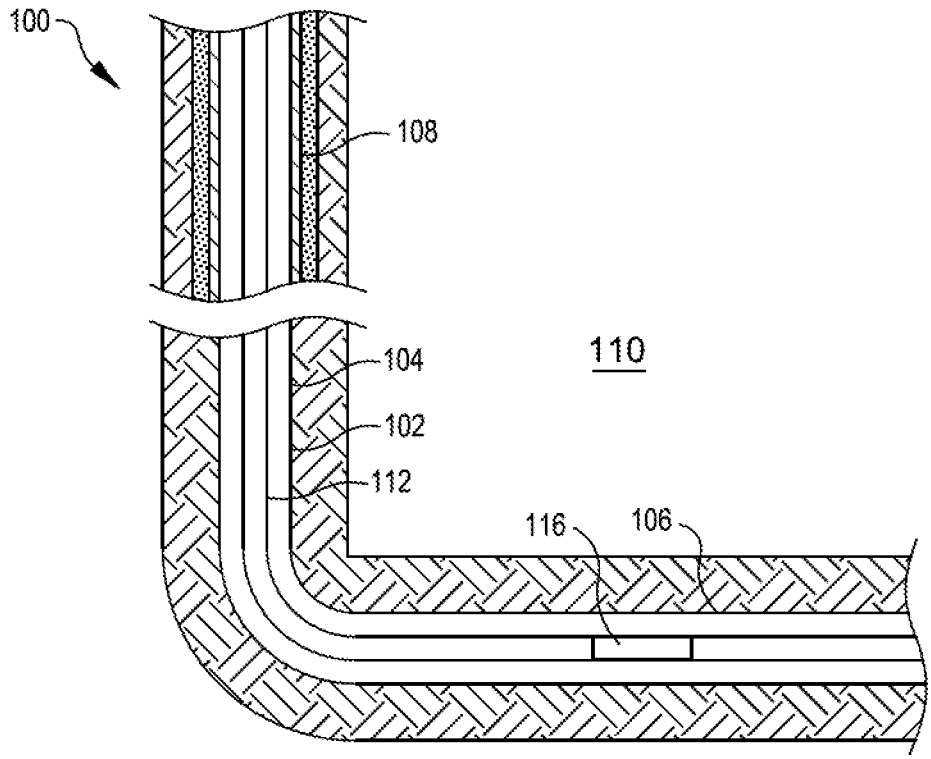
FIG. 1 is a schematic illustration of a well system having a pipe swell tool according to one aspect of the present disclosure.

FIG. 1 schematically depicts an example of a well system 100 having a tubing string 112 with a pipe swell tool 116. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

The tubing string 112 within wellbore 102 extends from the surface to the subterranean formation 110. The tubing string 112 can provide a conduit for formation fluids, such as production fluids produced from the subterranean formation 110, to travel from the substantially horizontal section 106 to the surface. Pressure from a bore in a subterranean formation 110 can cause formation fluids, including production fluids such as gas or petroleum, to flow to the surface.

The well system 100 can also include one or more pipe swell tools 116. Pressure applied to the pipe swell tool 116 can provide a force for powering or actuating a tool in the tubing string 112. In some aspects, the pipe swell tool 116 and the tool powered or actuated by the pipe swell tool 116 can form a single assembly. In other aspects, the pipe swell tool 116 can be a separate assembly that can be coupled with the tool to provide power or actuation by the pipe swell tool 116.

Although FIG. 1 depicts the pipe swell tool 116 in the substantially horizontal section 106, the pipe swell tool 116 can be located, additionally or alternatively, in the substantially vertical section 104. In some aspects, the pipe swell tool 116 can be disposed in simpler wellbores, such as wellbores having only a substantially vertical section. The pipe swell tool 116 can be disposed in openhole environments, as depicted in FIG. 1, or in cased wells.

Figure 2:
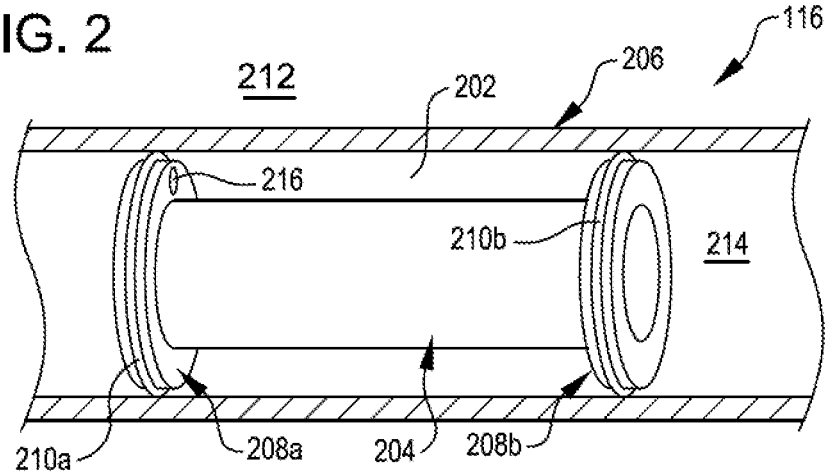
FIG. 2 is a cutaway perspective view of an example of a swell chamber of a pipe swell tool according to one aspect of the present disclosure.

FIG. 2 is a cutaway perspective view of an example of a swell chamber 202 of a pipe swell tool 116 according to one aspect of the present disclosure. The swell tool 116 can include an inner sleeve 204, an outer sleeve 206, and a swell chamber 202.

The outer sleeve 206 can be cylindrical. For example, the outer sleeve 206 may be a portion of tubing 112. The inner sleeve 204 can also be cylindrical. The inner sleeve 204 can be sized such that the inner sleeve 204 can fit within the outer sleeve 206. The inner sleeve 204 can be coupled to the outer sleeve 206.

The swell chamber 202 can be defined by the inner sleeve 204 and the outer sleeve 206. The inner sleeve 204 and the outer sleeve 206 can define boundaries of the swell chamber 202. The swell chamber 202 can be sealed such that fluid is restricted from entering or exiting the swell chamber 202 via a passage 216. The outer sleeve 206 can prevent fluid communication between the swell chamber 202 and an outer region 212 located adjacent to the outer sleeve 206. For example, the outer sleeve 206 can prevent fluid communication between the swell chamber 202 and an annulus between the tool 116 and a wall of the wellbore 102. The inner sleeve 204 can prevent fluid communication between the swell chamber 202 and an inner region 214 located adjacent to the inner sleeve 204. For example, the inner sleeve 204 can prevent fluid communication between the swell chamber 202 and an internal section of the tubing 112.

The inner sleeve 204 can include flanges 208*a*, 208*b*. The flanges 208*a*, 208*b* can extend from the inner sleeve 204 toward the outer sleeve 206 to further define the swell chamber 202. The seals 210*a*, 210*b* can circumferentially surround the flanges 208*a*, 208*b*, respectively. Non-limiting examples of the seals 210*a*, 210*b* include O-rings, V-rings, etc. The seals 210*a*, 210*b* an provide a seal between the inner sleeve 204 and the outer sleeve 206. The seals 210*a*, 210*b* or other suitable seals can be formed from any suitable flexible material, such as rubber. The flexible material can expand or contract in response to expansion or contraction of the inner sleeve 204 or the outer sleeve 206. In some aspects, expansion or contraction of the flexible material may maintain the seal between the inner sleeve 204 and the outer sleeve 206. The inner sleeve 204 having flanges 208*a*, 208*b*, the outer sleeve 206, and the seals 210*a*, 210*b* can provide fluid-tight boundaries for the swell chamber 202.

A passage 216 can be defined in a boundary of the swell chamber 202. The passage 216 can provide a path for fluid to enter or exit the swell chamber 202. In some aspects, fluid flow through the passage 216 can be restricted. As non-limiting examples, fluid flow through the passage 216 can be restricted by an aperture, a channel, a metering device, a check valve, etc. positioned in or adjacent to the passage 216. Fluid flow through the passage 216 can be restricted in one or both directions. In a non-limiting example, fluid flow out of the swell chamber 202 via the passage 216 may be restricted.

Figure 3:
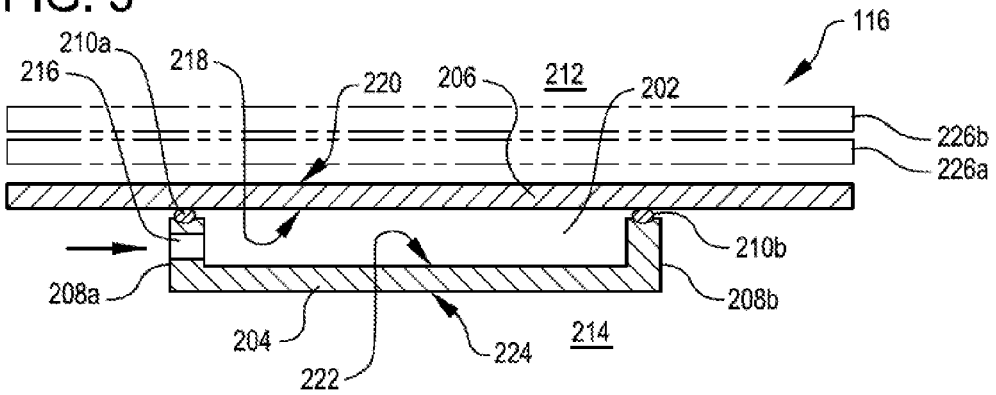
FIG. 3 is a cross-sectional view of an example of a swell chamber of a pipe swell tool according to one aspect of the present disclosure.

FIG. 3 is a cross-sectional view of an example of a swell chamber 202 of a pipe swell tool 116 according to one aspect of the present disclosure. The passage 216 can be positioned such that fluid flow is permitted between the inner region 214 and the swell chamber 202. Changing a pressure in the inner region 214 can cause fluid to flow into the swell chamber 202, as depicted by the rightward arrow in FIG. 3. Filling the swell chamber 202 with fluid from the inner region 214 can cause pressure to be applied to the boundaries of the swell chamber 202. The fluid within the swell chamber 202 can apply a force on an inner diameter 218 of the outer sleeve 206 that is less than or equal to a force exerted on an outer diameter 220 of the outer sleeve 206 by pressure from the outer region 212.

Figure 4:
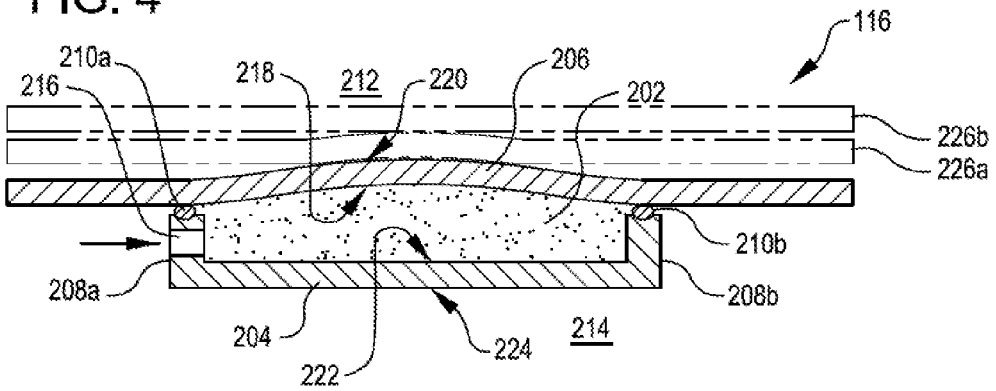
FIG. 4 is a cross-sectional view of the swell chamber of FIG. 3 for expanding to store fluid according to one aspect of the present disclosure.

FIG. 4 is a cross-sectional view of the swell chamber 202 of FIG. 3 for expanding to store fluid according to one aspect of the present disclosure. A pressure increase can be introduced into the inner region 214. For example, a section pressure of the tubing 112 can be increased via a control line or by directly increasing the tubing pressure in an inner diameter of the tubing 112 at the well surface. The pressure increase in the inner region 214 can cause pressure to increase in the swell chamber 202 via the passage 216. The pressure increase in the swell chamber 202 can cause the pressure level in the swell chamber 202 to exceed the pressure level in the outer region 212. The difference in pressures can cause a pressure differential across the outer sleeve 206. The pressure differential across the outer sleeve 206 can cause the outer sleeve 206 to swell or expand toward the lower pressure of the outer region 212, as depicted in FIG. 4.

Communication of pressure between the inner region 214 and the swell chamber 202 via the passage 216 can cause the pressure level in the swell chamber 202 to be equal or approximately equal to the pressure level in the inner region 214 at equilibrium. The pressure within the swell chamber 202 and the pressure in the inner region 214 can be exerted on opposite sides 222 and 224 of the inner sleeve 204. The minimal or zero difference in pressures on opposite sides 222 and 224 of the inner sleeve 204 at equilibrium can cause a minimal or zero pressure differential across the inner sleeve 204. In some aspects, the minimal or zero pressure differential can allow the inner sleeve 204 to remain rigid or otherwise prevent the inner sleeve 204 from deforming. For example, the inner sleeve 204 may be sufficiently rigid such that a pressure differential may be too low to cause expansion or other deformation of the inner sleeve 204. In other aspects, the minimal pressure differential can cause the inner sleeve 204 to expand toward the outer sleeve 206. The amount of expansion of the inner sleeve 204 toward the outer sleeve 206 can be less than the amount of expansion of the outer sleeve 206 in the same direction. A difference in the amount of the expansion of the inner sleeve 204 and the expansion of the outer sleeve 206 can be due to the smaller magnitude of the pressure differential exerted on the inner sleeve 204 in comparison to the pressure differential exerted on the outer sleeve 206.

Expansion of the outer sleeve 206 can increase the volume in the swell chamber 202. The additional volume can be filled with fluid communicated from the inner region 214 to the swell chamber 202 via the passage 216. The passage 216 can be sealed or restricted to store the additional volume of fluid in the swell chamber 202. The additional volume of fluid can be maintained in the swell chamber 202 as a stored source of pressure.

A housing 226*a* can be positioned proximate to the outer sleeve 206. The housing 226*a* can be positioned sufficiently close to the outer sleeve 206 such that expansion of the outer sleeve 206 can cause the outer sleeve 206 to contact the housing 226*a*. Contact between the housing 226*a* and the outer sleeve 206 can limit the amount by which the outer sleeve 206 can expand. Limiting expansion of the outer sleeve 206 can prevent the outer sleeve 206 from expanding to a point at which the outer sleeve 206 may rupture or otherwise be damaged.

In some aspects, expansion of the outer sleeve 206 can cause the housing 226*a* to expand. A secondary housing 226*b* can be positioned adjacent to the housing 226*a*. The secondary housing 226*a* can be positioned sufficiently close to the housing 226*a* such that expansion of the housing 226*a* can cause the housing 226*a* to contact the secondary housing 226*b*. Contact between the housing 226*a* and the secondary housing 226*b* can limit the amount by which the housing 226*a* can expand. In some aspects, one or more successively larger housings positioned external to the housings 226*a*, 226*b*, etc. can be nested to limit expansion to a point of rupture or damage. Utilizing multiple housings 226*a*, 226*b* can allow greater levels of pressure to be exerted upon the outer sleeve 206 without causing expansion of the outer sleeve 206 to a point of rupture or damage. In some aspects, one or more of the housings 226*a*, 226*b* can be omitted.

Figure 5:
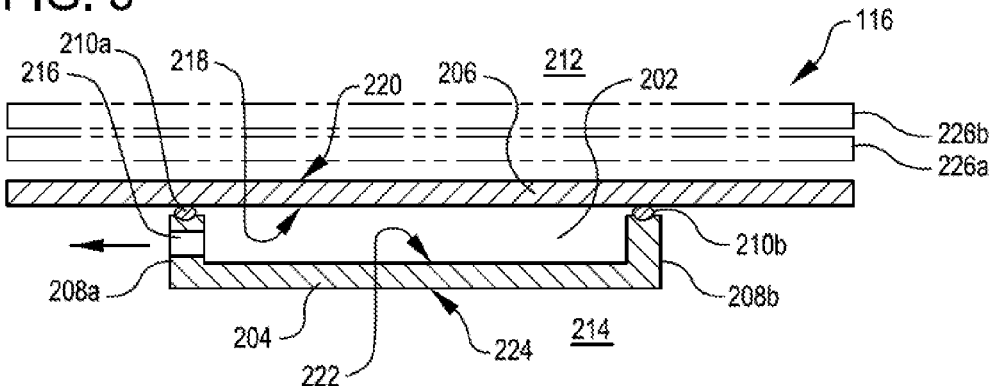
FIG. 5 is a cross-sectional view of the swell chamber of FIGS. 3-4 for contracting to expel stored fluid according to one aspect of the present disclosure.

FIG. 5 is a cross-sectional view of the swell chamber 202 of FIGS. 3-4 for contracting to expel stored fluid according to one aspect of the present disclosure. A pressure decrease can be introduced into the inner region 214. For example, a section pressure of the tubing 112 can be decreased via a control line or by directly decreasing the tubing pressure in an inner diameter of the tubing 112 at the well surface. The pressure decrease in the inner region 214 can cause the pressure level in the inner region 214 to be lower than the pressure level in the swell chamber 202. The pressure difference between the inner region 214 and the swell chamber 202 can cause the stored volume of fluid depicted in FIG. 4 to flow through the passage 216 from the swell chamber 202 into the inner region 214. The stored volume of fluid can be utilized as a source of pressure to actuate a downhole tool. Expulsion of the stored volume of fluid from the swell chamber 202 can reduce the pressure level in the swell chamber 202. Reducing the pressure in the swell chamber 202 can allow the outer sleeve 206 to contract to the unexpanded state depicted in FIGS. 3 and 5.

Although FIGS. 3-5 depict an outer sleeve 206 that expands in response to pressure in the swell chamber 202 and an inner sleeve 204 that remains rigid in response to the pressure, other implementations are possible. For example, the outer sleeve 206 can contract in response to a pressure in the swell chamber 202 or in the outer region 212. In additional or alternative aspects, the outer sleeve 206 can remain rigid and the inner sleeve 204 can expand or contract in response to a pressure in the swell chamber 202.

Figure 6:
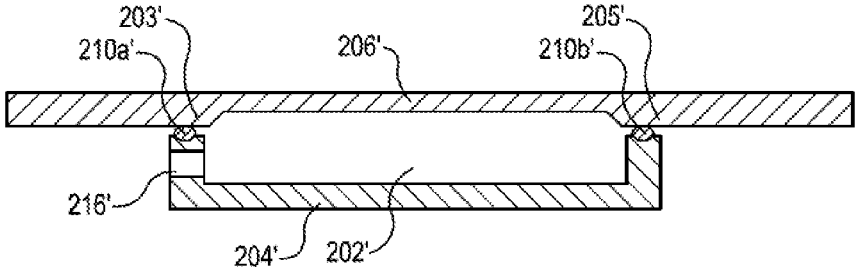
FIG. 6 is a cross-sectional view of an example of an alternative swell chamber of a pipe swell tool according to one aspect of the present disclosure.

FIG. 6 is a cross-sectional view of an example of an alternative swell chamber 202' of a pipe swell tool 116 according to one aspect of the present disclosure. The swell chamber 202' can be defined by an inner sleeve 204' and an outer sleeve 206'. The seals 210*a*', 210*b*' can be positioned between the inner sleeve 204' and the outer sleeve 206'. Positioning the seals 210*a*', 10*b*', between the inner sleeve 204' and the outer sleeve 206' can provide a fluid-tight seal for the swell chamber 202'. The seals 210*a*', 210*b*' can be positioned between the inner sleeve 204' and portions 203', 205' of the outer sleeve 206' that do not substantially expand or contract. The portions 203', 205' of the outer sleeve 206' that do not substantially expand or contract may be of a different material, strength, or dimension than the rest of the outer sleeve 206'. For example, as depicted in FIG. 6, portions of the outer sleeve 206' that are thicker than other portions of the outer sleeve 206' may provide the portions 203', 205' of the outer sleeve 206' that do not substantially expand or contract. The positions of the seals 210*a*', 210*b*' between the inner sleeve 204' and portions 203', 205' of the outer sleeve 206' can maintain a seal between the inner sleeve 204' and the outer sleeve 206' without substantial expansion or contraction of the seals 210*a*', 210*b*'.

Figure 7:
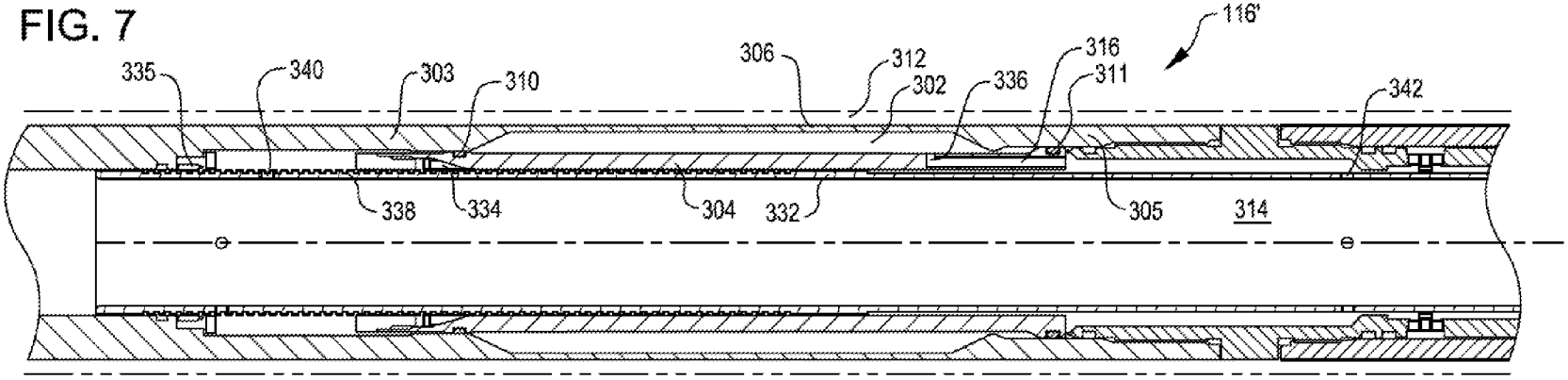
FIG. 7 is a cross-sectional view of an example of a pipe swell tool having a swell chamber for moving a sliding sleeve according to one aspect of the present disclosure.

Pressure stored in a swell chamber 202 or 202' can be used to actuate downhole tools. For example, FIG. 7 is a cross-sectional view of an example of a pipe swell tool 116' having a swell chamber 302 for moving a sliding sleeve 332 according to one aspect of the present disclosure. In some aspects, the pipe swell tool 116 can be part of a tubing string 112. The pipe swell tool 116 can include a sliding sleeve 332, a swell chamber 302, an inner sleeve 304, an outer sleeve 306, a shifting mechanism 334, and a snap ring 335.

The inner sleeve 304 can be coupled to the outer sleeve 306. The swell chamber 302 can be positioned between the inner sleeve 304 and the outer sleeve 306. The inner sleeve 304 and the outer sleeve 306 can define boundaries of the swell chamber 302.

Seals 310, 311 (e.g., O-rings, V-rings, etc.) can be positioned between the inner sleeve 304 and the outer sleeve 306. Positioning the seals 310, 311 between the inner sleeve 304 and the outer sleeve 306 can provide a fluid-tight seal for the swell chamber 302. The seals 310, 311 can be positioned between the inner sleeve 304 and thicker portions 303, 305 of the outer sleeve 306 that do not substantially expand or contract. Positioning the seals 310, 311 between the inner sleeve 304 and portions 303, 305 of the outer sleeve 306 can maintain the seal between the inner sleeve 304 and the outer sleeve 306 without substantial expansion or contraction of the seals 310, 311.

Figure 8:
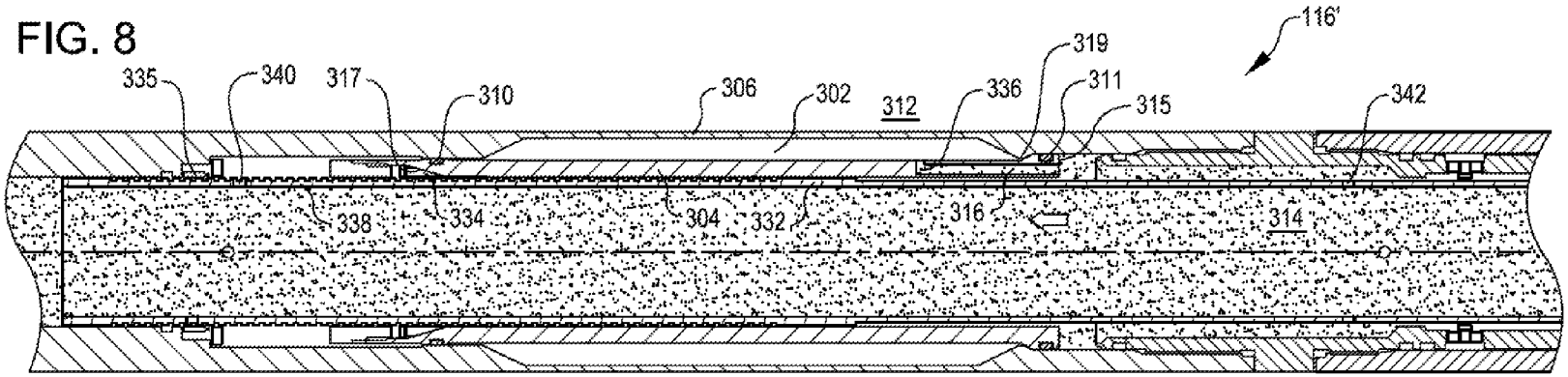
FIG. 8 is a cross-sectional view of the pipe swell tool of FIG. 7 for utilizing a pressure change for moving the sliding sleeve according to one aspect of the present disclosure.
Figure 9:
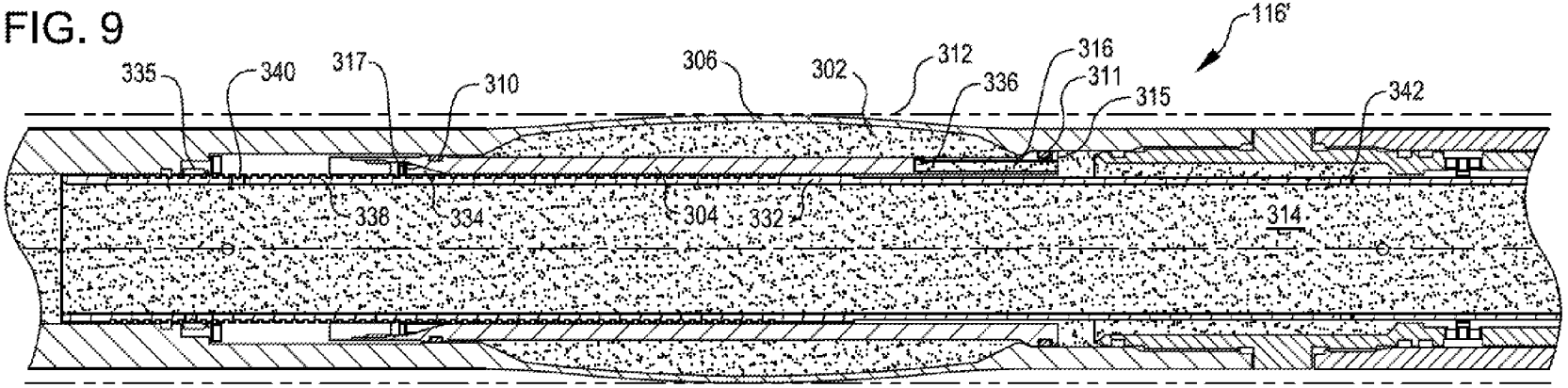
FIG. 9 is a cross-sectional view of the pipe swell tool of FIGS. 7-8 for storing a volume of fluid for moving an inner sleeve according to one aspect of the present disclosure.

The swell chamber 302 can be in fluid communication with a passage 316. The passage 316 can provide fluid flow between the swell chamber 302 and an inner region 314 of the pipe swell tool 116'. Although FIGS. 7-9 depict the passage 316 positioned in the inner sleeve 304, the passage 316 can be positioned in any suitable location to provide fluid flow between the inner region 314 and the swell chamber 302. In one non-limiting example, the passage 316 can be positioned in the outer sleeve 306.

The passage 316 can include a metering mechanism 336. The metering mechanism 336 can limit the rate of fluid flow between the inner region 314 and the swell chamber 302. For example, the metering mechanism 336 can include a small aperture that can limit the amount of fluid that may flow through the aperture at once.

The inner sleeve 304 can be coupled with the shifting mechanism 334. Movement of inner sleeve 304 can cause movement of the shifting mechanism 334. Movement of the shifting mechanism 334 can engage certain shifting features 338 positioned on the sliding sleeve 332. A non-limiting example of a shifting mechanism 334 is a ratcheting mechanism, such as (but to limited to) a spring-loaded pawl having an angled side to push the pawl out of interference with a tooth when the tooth is moved in a first direction and flat side to lock the pawl against the tooth when the tooth is moved in a second direction.

The sliding sleeve 332 can be positioned within the pipe swell tool 116'. The sliding sleeve 332 can include ports 340 and 342. The ports 340 and 342 can provide fluid flow between the inner region 314 and the inner sleeve 304.

The snap ring 335 can be positioned within the pipe swell tool 116'. The snap ring 335 can be positioned to contact the sliding sleeve 332. The snap ring 335 may include teeth that can contact the sliding sleeve 332. Contact between the snap ring 335 and the sliding sleeve 332 can inhibit movement of the sliding sleeve 332 in one direction. For example, the snap ring 335 may permit movement of the sliding sleeve 332 in the direction depicted by the leftward arrow in FIG. 8 and inhibit movement of the sliding sleeve 332 in the direction opposite the direction depicted by the leftward arrow in FIG. 8.

FIG. 8 is a cross-sectional view of the pipe swell tool 116' of FIG. 7 for utilizing a pressure change for moving the sliding sleeve 332 according to one aspect of the present disclosure. A pressure increase (depicted in FIG. 8 by dotted shading) can be introduced into the inner region 314. For example, a section pressure of tubing 112 can be increased via a control line or by directly increasing the tubing pressure in an inner diameter of the tubing 112 at the well surface. The increased pressure in the inner region 314 can cause fluid to flow from the inner region 314 into the swell chamber 302. The metering device 336 can restrict the flow of fluid from the inner region 314 into the swell chamber 302. Restricting the flow of fluid into the swell chamber 302 can cause the pressure in the swell chamber 302 to be less than the pressure in the inner region 314.

A first end 315 of the inner sleeve 304 can have a larger amount of surface area than a second end 317 of the inner sleeve 304. For example, as depicted in FIG. 7, the first end 315 of the inner sleeve 304 can be thicker than the second end 317 of the inner sleeve 304. In some aspects, the seal 311 can provide at least part of the larger amount of surface area of the first end 315 of the inner sleeve 304. The larger amount of surface area of the first end 315 can provide a greater cross-sectional area exposed to the swell chamber 302, the inner region 314, or both.

A net pressure applied to the greater surface area of the first end 315 of the inner sleeve 304 can cause the inner sleeve 304 to move. The difference between the greater pressure in the inner region 314 and the lesser pressure in the swell chamber 302 can exert a net pressure on the first end 315 of the inner sleeve 304. The net pressure exerted on the first end 315 can cause the inner sleeve 304 to move in the direction depicted by the leftward arrow in FIG. 8. Movement of the inner sleeve 304 can cause movement of the sliding sleeve 332 via the shifting mechanism 334. Movement of the inner sleeve 304 may be limited by the geometry of structure adjacent to the inner sleeve 304. For example, as depicted in FIG. 8, the movement of the inner sleeve 304 may be limited by contact between the first end 315 of the inner sleeve 304 and a shoulder 319 provided by the outer sleeve 306.

FIG. 9 is a cross-sectional view of the pipe swell tool 116' of FIGS. 7-8 for storing a volume of fluid for moving an inner sleeve 304 according to one aspect of the present disclosure. The increased pressure in the inner region 314 can cause fluid to flow from the inner region 314 into the swell chamber 302. The fluid can flow from the inner region 314 into the swell chamber 302 via the passage 316 and one or more of the ports 340, 342. The metering device 336 in the passage 316 can provide a limited flow of fluid from the inner region 314 into the swell chamber 302. Passage of fluid from the inner region 314 to the swell chamber 302 can produce a pressure increase in the swell chamber 302. Increasing the pressure in the swell chamber 302 can cause the outer sleeve 306 to expand. Expanding the outer sleeve 306 can increase a volume of the swell chamber 302. The additional volume can be filled with fluid communicated from the inner region 314 via the passage 316. The stored volume of fluid in the swell chamber 302 can be used to move the inner sleeve 304, as described in greater detail with regard to FIG. 10.

Figure 10:
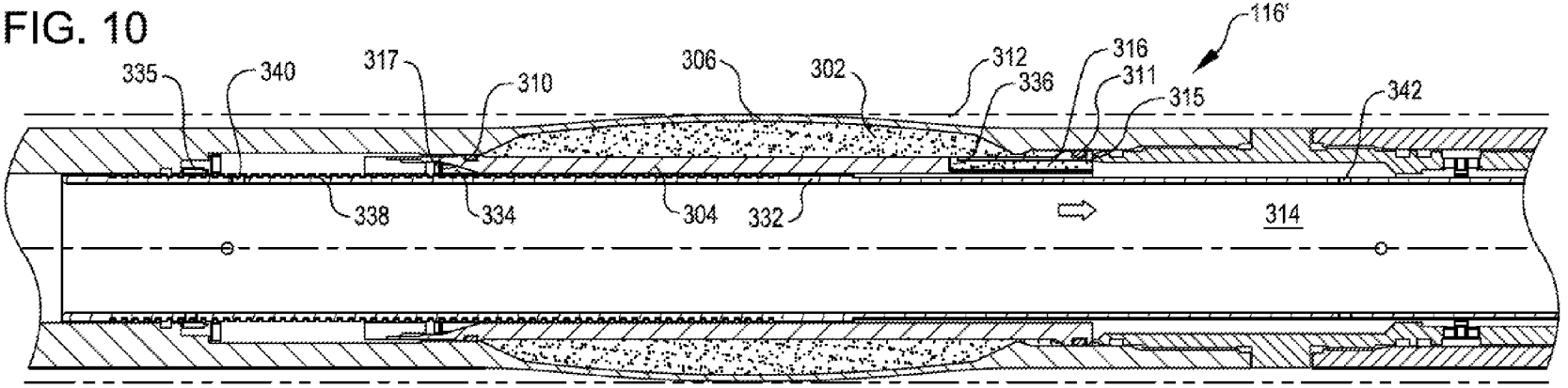
FIG. 10 is a cross-sectional view of the pipe swell tool of FIGS. 7-9 for utilizing the pressure of the stored fluid to move the inner sleeve according to one aspect of the present disclosure.

FIG. 10 is a cross-sectional view of the pipe swell tool 116' of FIGS. 7-9 for utilizing the pressure of the stored fluid to move the inner sleeve 304 according to one aspect of the present disclosure.

A pressure decrease can be introduced into the inner region 314. For example, a section pressure of tubing 112 can be decreased via a control line or by directly decreasing the tubing pressure in an inner diameter of the tubing 112 at the well surface. The decreased pressure in the inner region 314 can cause fluid to flow from the swell chamber 302 into the inner region 314. The metering device 336 can restrict the flow of fluid from the swell chamber 302 into the inner region 314. Restricting the flow of fluid from the swell chamber 302 into the inner region 314 can store a volume of fluid in the swell chamber 302. Storing the volume of fluid in the swell chamber 302 can produce a pressure difference between the inner region 314 and the swell chamber 302. The pressure difference between the inner region 314 and the swell chamber 302 can cause the swell chamber 302 to have a greater pressure than the level of pressure in the inner region 314.

The difference between the lesser pressure in the inner region 314 and the greater pressure in the swell chamber 302 can exert a net pressure on the first end 315 of the inner sleeve 304. The net pressure can cause the inner sleeve 304 to move in the direction depicted by the rightward arrow in FIG. 10. The shifting mechanism 334 can be configured to allow movement of the inner sleeve 304 independent of the sliding sleeve 332. Independent movement can allow the inner sleeve 304 to return to the position depicted in FIG. 7 without causing a corresponding return movement of the sliding sleeve 332. Contact between the snap ring 335 and the sliding sleeve 332 can maintain the position of the sliding sleeve 332. The snap ring 335 can prevent a corresponding return movement of the sliding sleeve 332 from occurring with the return movement of the inner sleeve 304.

The metering device 336 in the passage 316 can provide a limited flow of fluid to the inner region 314 from the swell chamber 302. Passage of fluid from the swell chamber 302 can reduce the pressure in the swell chamber 302. Reducing the pressure in the swell chamber 302 can allow outer sleeve 306 to contract toward the position depicted in FIG. 7. Cyclical increasing and decreasing of pressure in the inner region 314 can cycle the inner sleeve 304 back and forth to cause incremental movement of the sliding sleeve 332 in the direction depicted by the leftward arrow in FIG. 8.

In some aspects, the sliding sleeve 332 can be incrementally moved regardless of the pressure outside of the pipe swell tool 116'. For example, the pipe swell tool 116' can be actuated for implementations in which a pressure in an annulus between the formation 110 and the pipe swell tool 116' has negligible pressure.

In additional or alternative aspects, a leak occurring at one or more of the seals 310, 311 may produce a leak limited to the interior of the tool 116' and avert a leak between the tubing 112 and the annulus formed between the formation 110 and the tubing 112.

Although the inner sleeve 304 is described with regard to FIGS. 7-10 as shifting or causing movement of the sliding sleeve 332 when moving in the direction depicted by the leftward arrow in FIG. 8, other arrangements are possible. For example, the shifting mechanism 334 may be reversed such that the sliding sleeve 332 is moved in response to movement of the inner sleeve 304 in the direction depicted by the rightward arrow in FIG. 10. Furthermore, although the inner sleeve 304 is described with regard to FIGS. 7-10 as moving in the direction depicted by the leftward arrow in FIG. 8 in response to a pressure increase in the inner region 314, other arrangements are possible. For example, the inner sleeve 304 could be flipped horizontally relative to FIG. 8 to provide a configuration in which the inner sleeve 304 may move in a direction opposite the leftward arrow depicted in FIG. 8 in response to a pressure increase in the inner region 314.

Figure 11:
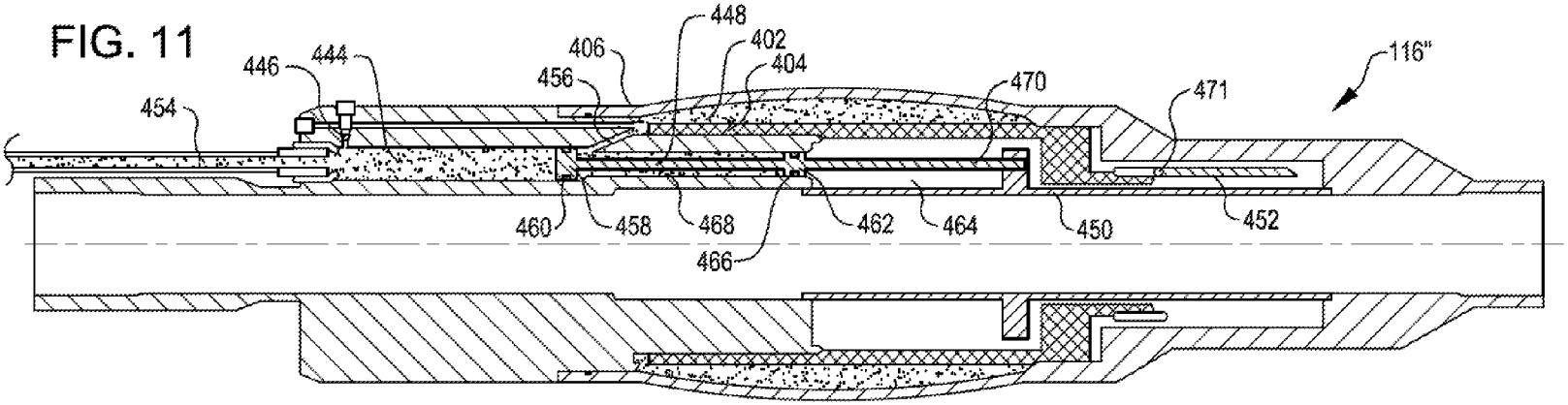
FIG. 11 is a cross-sectional view of an example of a pipe swell tool having a swell chamber for operating a safety valve according to one aspect of the present disclosure.

FIG. 11 is a cross-sectional view of an example of a pipe swell tool 116" having a swell chamber 402 for operating a safety valve according to one aspect of the present disclosure. The pipe swell tool 116" may be part of a tubing string 112. The pipe swell tool 116" can include a chamber 444, a check valve 446, a swell chamber 402, a piston 448, a flow tube 450, and a valve closure mechanism such as a flapper 452.

The pressure level in the chamber 444 can be controlled by a control line 454. The chamber 444 can be connected to the control line 454. The control line 454 can control the pressure level in the chamber 444 by communicating fluid into or out of the chamber 444. The chamber 444 can be adjacent to the piston 448. The chamber 444 can be in fluid communication with a check valve 446.

The check valve 446 can allow fluid flow from the chamber 444 to the swell chamber 402. The check valve 446 can prevent or restrict fluid flow from the swell chamber 402 to the chamber 444. For example, the check valve 446 may include a ball that is pushed into sealing contact with an orifice. A pressure in the swell chamber 402 that is higher than the pressure in the chamber 444 can cause the ball to seat over the orifice such that flow is prevented through the orifice. A pressure in the chamber 444 that is higher than the pressure in the swell chamber 402 can move the ball away from the orifice such that flow is allowed through the orifice.

The swell chamber 402 can include an outer sleeve 406 coupled with an inner sleeve 404. The swell chamber 402 can be positioned between the inner sleeve 404 and the outer sleeve 406. The inner sleeve 404 and the outer sleeve 406 can define boundaries of the swell chamber 402. Part or all of the outer sleeve 406 can expand in response to a fluid flow from the chamber 444 to the swell chamber 402. In some aspects (such as depicted in FIG. 11), the inner sleeve 404 can remain rigid in response to the fluid flow from the chamber 444 to the swell chamber 402.

The swell chamber 402 can be in fluid communication with a port 456. The port 456 can be in fluid communication with the piston 448.

The piston 448 can include a first piston head 458. The first piston head 458 of the piston 448 can be in fluid communication with the chamber 444. The first piston head 458 can be in fluid communication with the port 456. The first piston head 458 can include a first seal 460 to prevent fluid flow between the chamber 444 and the port 456 along the first piston head 458. As a non-limiting example, the first seal 460 may include an O-ring.

The piston 448 can include a second piston head 462. The second piston head 462 of the piston 448 can be in fluid communication with the port 456. The second piston head 462 can be in fluid communication with a rod chamber 464. The second piston head 462 can include a second seal 466 to prevent fluid flow between the port 456 and the rod chamber 464 along the second piston head 462. As a non-limiting example, the second seal 466 may include an O-ring.

An annulus 468 can include a space along the piston 448 and between the first piston head 458 and the second piston head 462 of the piston 448. The annulus 468 can provide fluid flow between the port 456 and the first piston head 458. The annulus 468 can provide fluid flow between the port 456 and the second piston head 462.

The piston 448 can include a rod 470 extending into the rod chamber 464. The rod 470 can extend from the second piston head 462. The rod 470 can be connected to the flow tube 450. Connection of the rod 470 and the flow tube 450 can allow movement of the rod 470 to cause movement of flow tube 450.

The flow tube 450 can be positioned within the tubing 112. The flow tube 450 can be positioned adjacent to the flapper 452. Movement of the flow tube 450 can cause movement of the flapper 452. The flapper 452 can move between an open position and a closed position. The flapper 452 in the open position may allow fluid flow in the tubing 112. The flapper 452 in the closed position can block fluid flow in the tubing 112. The flapper 452 is depicted in FIG. 11 in the open position.

Pressure in the chamber 444 can be increased. For example, fluid may be introduced into the chamber 444 via the control line 454. Increasing the pressure in the chamber 444 can cause the check valve 446 to open. Opening the check valve 446 can allow fluid to flow into the swell chamber 402. Fluid flow from the chamber 444 into the swell chamber 402 can cause the outer sleeve 406 to expand. Expanding the outer sleeve 406 can increase a volume in the swell chamber 402. Increasing the volume of the swell chamber 402 can allow additional fluid to flow from the chamber 444 into the swell chamber 402.

Fluid can also be communicated from the chamber 444 to the annulus 468 via the open check valve 446 and the port 456. Fluid flow from the chamber 444 to the annulus 468 can allow a pressure in the annulus 468 to be equal or approximately equal to a pressure in the chamber 444. The equal or approximately equal pressure applied to either side of the first piston head 458 can have a negligible effect on the position of the piston 448. Fluid flow from the chamber 444 to the annulus 468 can also cause a pressure in the annulus 468 to be greater than a pressure in the rod chamber 464. The difference in pressure between the higher pressure in the annulus 468 and the lower pressure in the rod chamber 464 can urge the piston 448 in the rightward direction of FIG. 11 and maintain the piston 448 in the position shown in FIG. 11.

Figure 12:
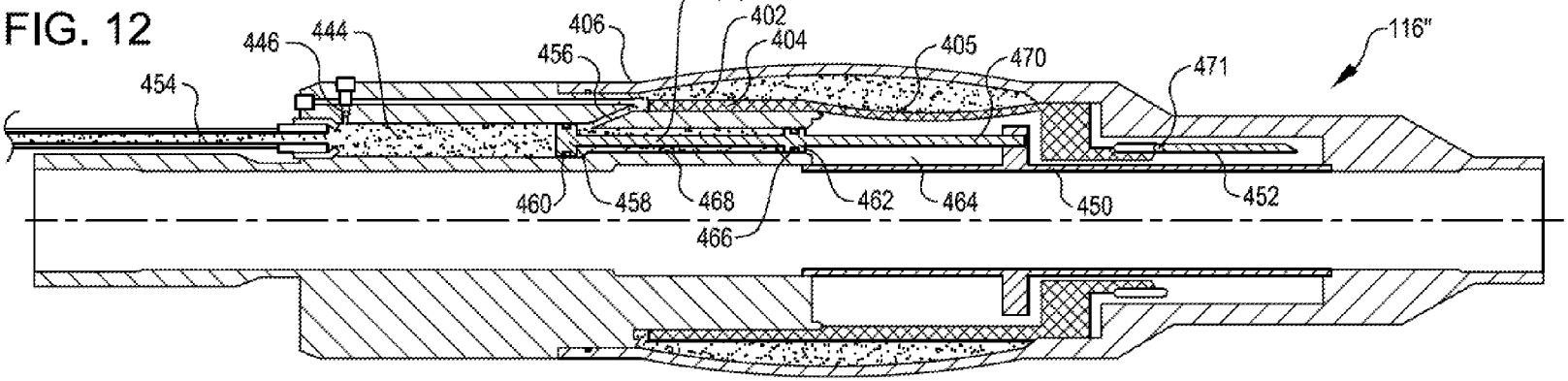
FIG. 12 is a cross-sectional view of the pipe swell tool of FIG. 11 having an expandable inner sleeve according to one aspect of the present disclosure.

FIG. 12 is a cross-sectional view of the pipe swell tool 116" of FIG. 11 having an expandable inner sleeve 404 according to one aspect of the present disclosure. In some aspects (such as depicted in FIG. 12), part or all of the inner sleeve 404 can expand in response to the fluid flow from the chamber 444 to the swell chamber 402. Expansion of the inner sleeve 404 can increase a volume in the swell chamber 402. The volume increase in the swell chamber 402 due to the expansion of the inner sleeve 404 can be an addition or an alternative to the volume increase due to the expansion of the outer sleeve 406. The inner sleeve 404 can include a section 405 that is thinner than other portions of the inner sleeve 404 or the outer sleeve 406. The smaller thickness of the thinner section 405 can allow the thinner section 405 to expand to a greater degree or at a lower pressure than other portions of the inner sleeve 404 or the outer sleeve 406.

Figure 13:
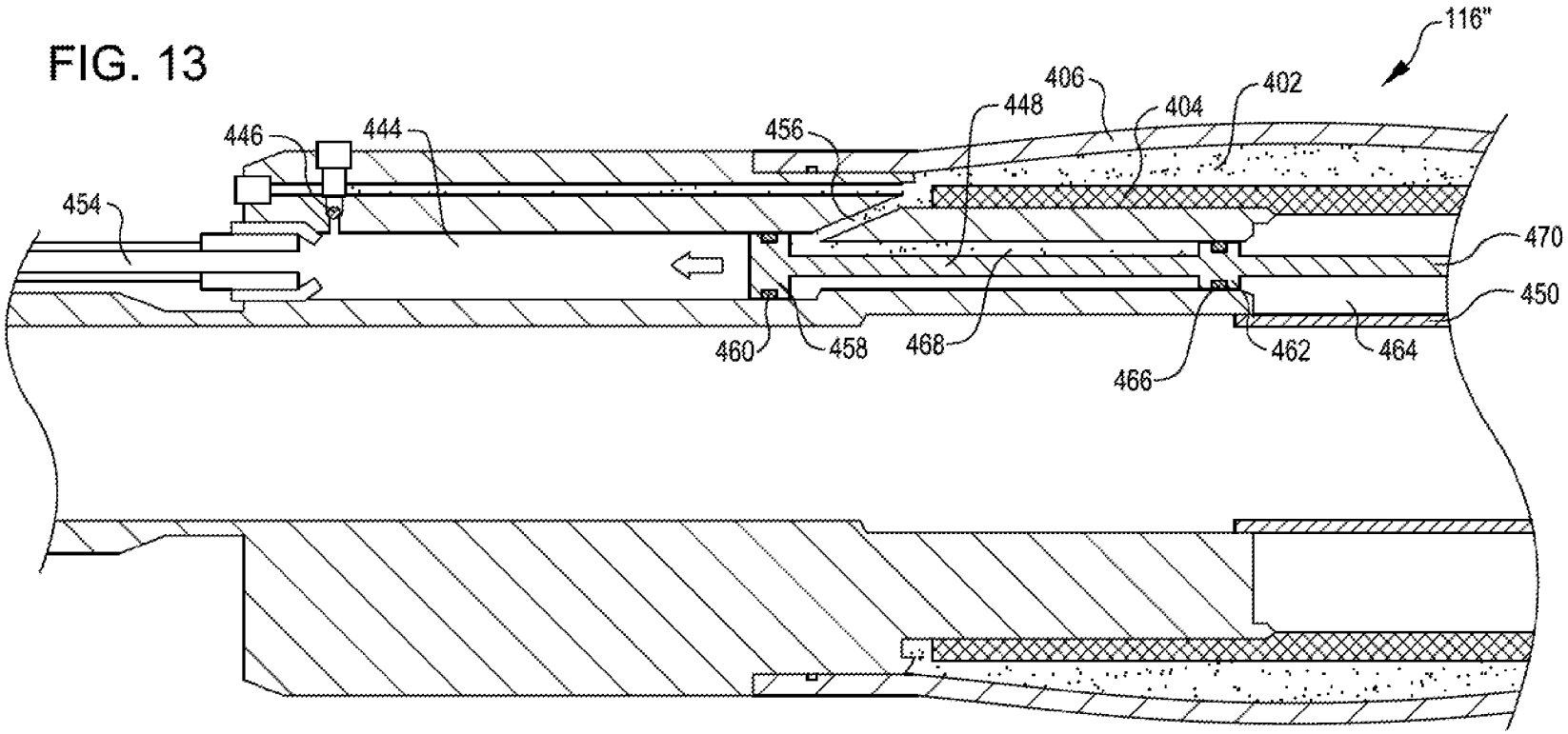
FIG. 13 is a cross-sectional view of a portion of the pipe swell tool of FIG. 11 for storing a volume of fluid in a swell chamber according to one aspect of the present disclosure.

FIG. 13 is a cross-sectional view of a portion of the pipe swell tool 116" of FIG. 11 for storing a volume of fluid in a swell chamber 402 according to one aspect of the present disclosure.

Pressure in the chamber 444 can be decreased. For example, fluid pressure in the chamber 444 can be regulated via the control line 454. Decreased pressure in the chamber 444 can decrease the amount of fluid flow from the chamber 444 to the swell chamber 402 via the check valve 446. Decreasing the amount of fluid flow via the check valve 446 can cause the check valve 446 to close. Closing the check valve 446 can prevent fluid flow from the swell chamber 402 into the chamber 444. Preventing fluid flow to the chamber 444 from the swell chamber 402 can cause the pressure level in the chamber 444 to be lower than the pressure level in the swell chamber 402. The pressure level in the swell chamber 402 can be communicated to the annulus 468 via the port 456. A lower pressure in the chamber 444 relative to the annulus 468 can exert a force on the first piston head 458. The force exerted on the first piston head 458 can cause the piston 448 to move in the direction depicted by the leftward arrow in FIG. 13.

Figure 14:
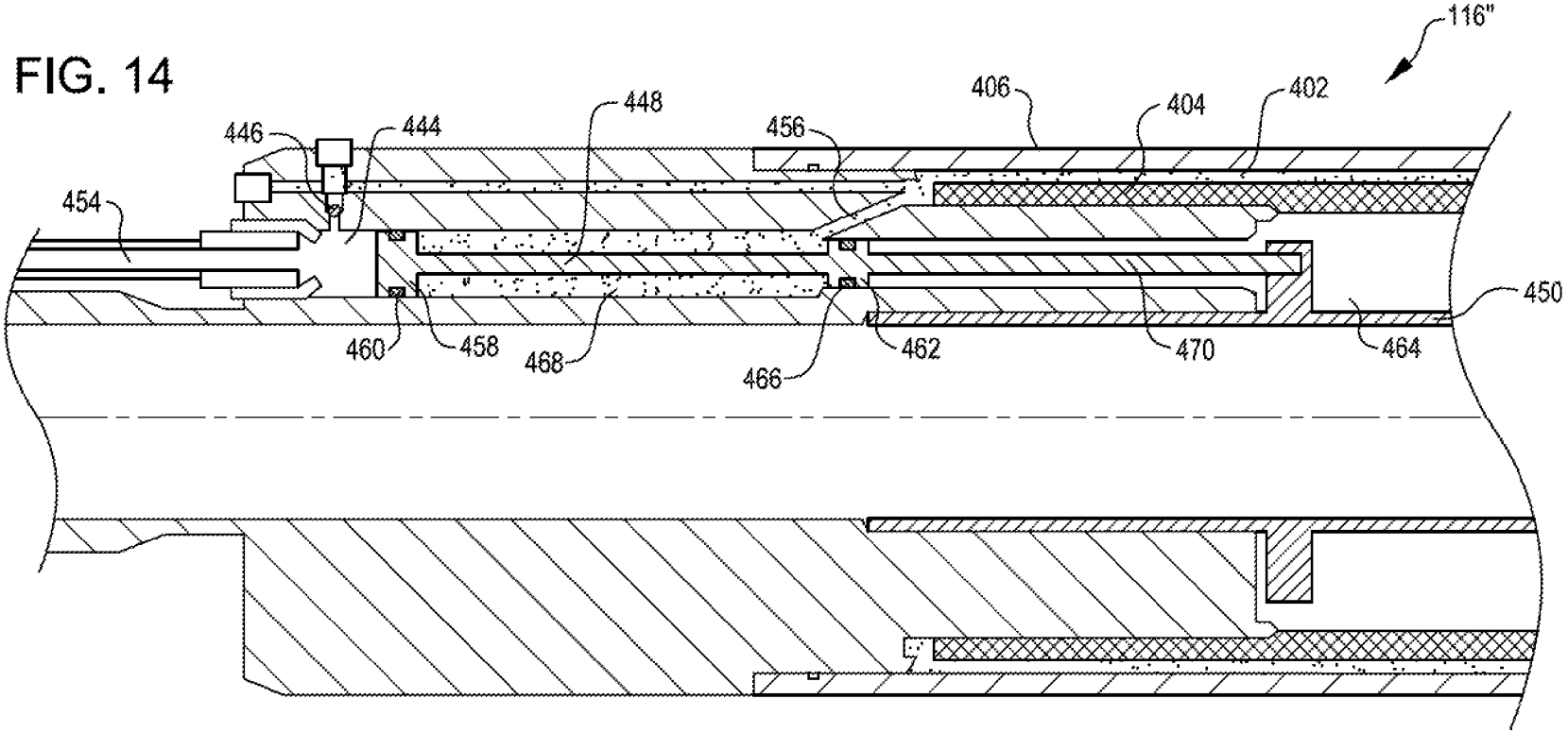
FIG. 14 is a cross-sectional view of a portion of the pipe swell tool of FIG. 11 for expelling the volume of fluid from the swell chamber to move a piston according to one aspect of the present disclosure.

FIG. 14 is a cross-sectional view of a portion of the pipe swell tool 116" of FIG. 11 for expelling the volume of fluid from the swell chamber 402 to move the piston 448 according to one aspect of the present disclosure.

Movement of the piston 448 can increase the volume of the annulus 468. Increasing the volume of the annulus 468 can allow the additional volume of fluid stored in the swell chamber 402 to be communicated via the port 456 to the annulus 468. Introducing the additional volume into the annulus 468 can maintain the higher pressure in the annulus 468 relative to the chamber 444. Maintaining the higher pressure in the annulus 468 can maintain the force exerted on the piston 448 to maintain the movement of the piston 448 or to maintain the piston 448 in the position depicted in FIG. 14. Allowing the additional volume of fluid stored in the swell chamber 402 to be communicated to the annulus 468 can also allow the outer sleeve 406 or inner sleeve 404 (or both) to return toward an un-expanded state.

Figure 15:
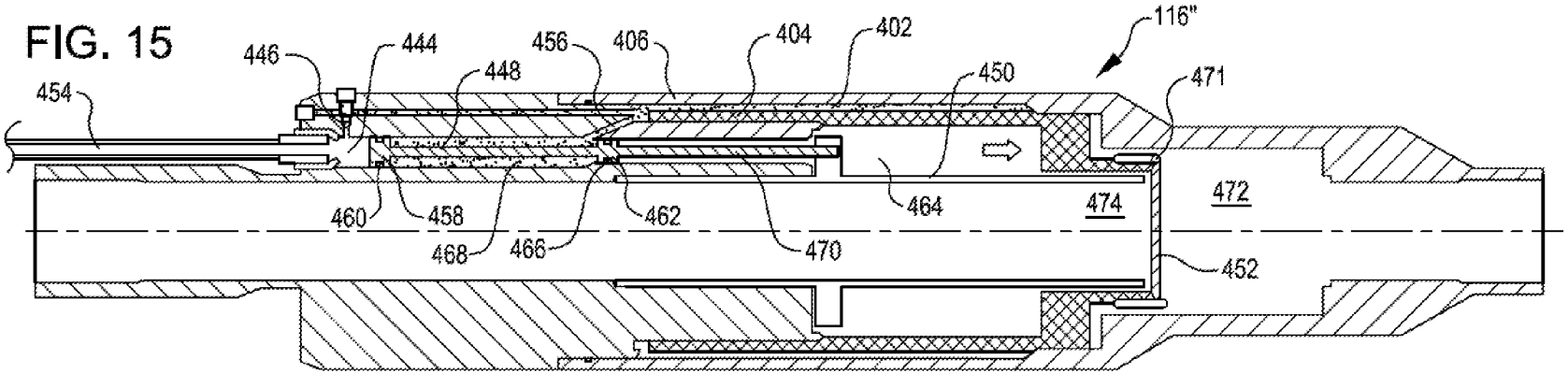
FIG. 15 is a cross-sectional view of the pipe swell tool of FIG. 11 for closing a flapper valve by moving the piston according to one aspect of the present disclosure.

FIG. 15 is a cross-sectional view of the pipe swell tool 116" of FIG. 11 for closing a flapper valve 452 by moving the piston 448 according to one aspect of the present disclosure.

As described above with regard to FIG. 14, decreasing a pressure in chamber 444 can cause the volume of fluid stored in the swell chamber 402 to move the piston 448 in the direction depicted by the leftward arrow in FIG. 13. Movement of piston 448 can cause the rod 470 to move in the direction depicted by the leftward arrow in FIG. 13. Movement of rod 470 can cause the flow tube 450 to move from the position depicted in FIG. 11 to the position depicted in FIG. 15. Movement of flow tube 450 can allow the flapper 452 to close. The flapper 452 is depicted in the closed position in FIG. 15. A torsion spring 471 may be included to urge the flapper 452 toward the closed position. The flapper 452 may also be held in the closed position by a closing force exerted by fluid provided at a position 472 adjacent to the flapper 452. For example, the fluid in the position 472 adjacent to the flapper 452 may be provided by a source downhole of the flapper 452.

The flapper 452 can also be re-opened. As described above regarding FIG. 11, increasing pressure in the chamber 444 can cause fluid to flow through the check valve 446 and into the annulus 468. Fluid communication to the annulus 468 can cause a pressure difference between the annulus 468 and the rod chamber 464. The pressure difference can exert a force on the second piston head 462 driving the second piston head 462 in the direction depicted by the rightward arrow in FIG. 15. Driving the piston 448 can move the flow tube 450. Movement of flow tube 450 can move the flapper 452 to the open position or hold the flapper 452 in the open position or both. Movement of the flow tube 450 and the flapper 452 can return the flow tube 450 and the flapper 452 to the configuration depicted in FIG. 11.

In some aspects, additional pressure can be provided at a position 474 proximate to the flapper 452. For example, additional pressure may be provided at the position 474 proximate to the flapper 452 by increasing the section pressure within the tubing 112. The additional pressure provided at the position 474 proximate to the flapper 452 can exert an opening force on the flapper 452 exceeding the closing force(s) exerted on the flapper 452 (such as by the torsion spring 471, by the fluid provided at the position 472 adjacent to the flapper 452, by other biasing members, or any combination thereof). The greater magnitude of the opening force relative to closing force(s) can cause the flapper 452 to move toward the open position.

Pressure in the chamber 444 can be varied relative to other parts in the tool 116" to cause the flapper 452 to open, to store a volume of fluid in the swell chamber 402, to utilize the volume of fluid stored in the swell chamber 402, or to close the flapper 452.

Figure 16:
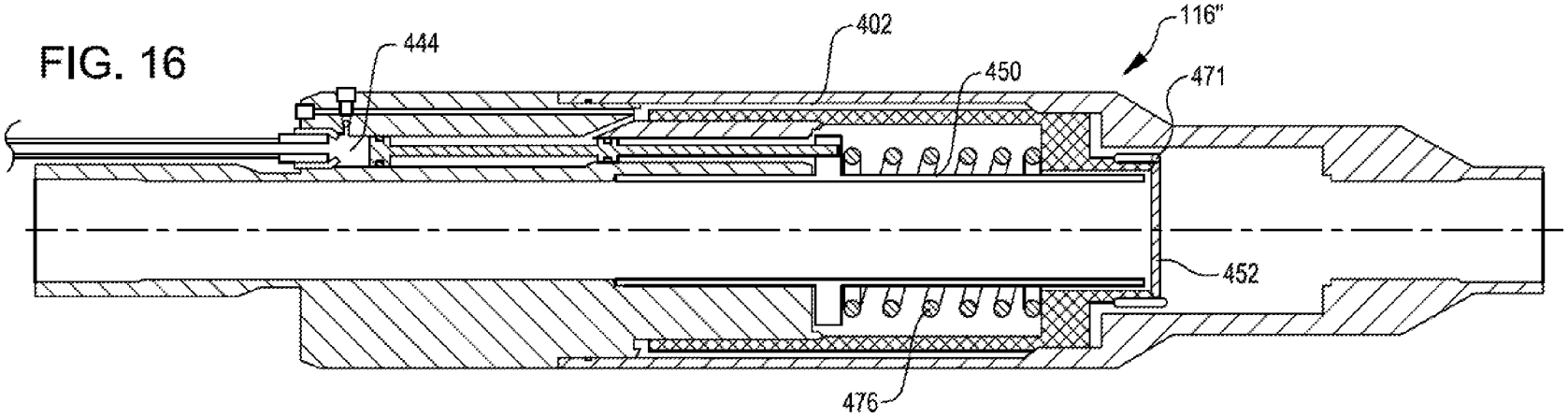
FIG. 16 is a cross-sectional view of the pipe swell tool of FIG. 15 having a biasing member according to one aspect of the present disclosure.

FIG. 16 is a cross-sectional view of the pipe swell tool 116" of FIG. 15 having a biasing member 476 according to one aspect of the present disclosure.

In some aspects, the pipe swell tool 116" can include a biasing member 476. As a non-limiting example, a biasing member 476 may be a spring. The biasing member 476 can bias the flapper 452 toward the open or closed position. For example, as depicted in FIG. 16, a spring may be utilized to bias the flow tube 450 toward a position in which the flapper 452 is closed.

Inclusion of the biasing member 476 can supplement the level of force provided by the volume of fluid stored in the swell chamber 402. Supplementing the level of force provided by the volume of fluid stored in the swell chamber 402 can reduce the level of force to be supplied by the swell chamber 402 to cause the flow tube 450 to move. Reducing the level of force to be supplied by the swell chamber 402 to cause the flow tube 450 to move can allow a smaller swell chamber 402 to be utilized. In additional or alternative aspects, increasing the size of the swell chamber 402 utilized may increase the amount of force provided by the volume of fluid stored in the swell chamber 402. Increasing the amount of force provided by the volume of fluid stored in the swell chamber 402 can reduce the strength, size, or both of the biasing spring to be used.

In additional or alternative aspects, liquids with a higher compressibility can be used to store a higher amount of energy within the swell chamber 402. Storing a higher amount of energy can allow for a smaller swell chamber 402 to be used. Storing a higher amount of energy can also provide a greater amount of force from a swell chamber of a set size. For example, storing a higher amount of energy may provide a higher closing force or a higher moving force for a longer tool stroke.

The foregoing description of the aspects, including illustrated examples, of the disclosure has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. A downhole assembly for a wellbore, the downhole assembly comprising:

a first sleeve expandable from a first position to a second position in response to a first pressure applied to the first sleeve and contractible to the first position in response to a cessation of the first pressure; and a second sleeve adjacent to the first sleeve, the first and second sleeves defining a swell chamber arranged to move a structure distinct from the first sleeve to actuate a downhole tool by a second pressure that is stored in the swell chamber by an expansion of the first sleeve.

2. The downhole assembly of claim 1, wherein the second sleeve is more rigid than the first sleeve in response to the first pressure.

3. The downhole assembly of claim 1, wherein the second sleeve is less rigid than the first sleeve in response to the first pressure.

4. The downhole assembly of claim 1, wherein the first sleeve circumferentially surrounds at least a portion of the second sleeve.

5. The downhole assembly of claim 1, further comprising a housing positioned external to the first sleeve and operable for limiting the expansion of the first sleeve.

6. The downhole assembly of claim 1, wherein the second sleeve remains rigid in response to the first pressure being applied to the second sleeve.

7. The downhole assembly of claim 1, further comprising a passage in fluid communication with the swell chamber and restricting fluid communication from the swell chamber.

8. The downhole assembly of claim 7, wherein the passage comprises at least one of a check valve or a metering mechanism.

9. The downhole assembly of claim 1, wherein the swell chamber shifts a sliding sleeve by the second pressure stored in the swell chamber by the expansion of the first sleeve.

10. The downhole assembly of claim 1, wherein the swell chamber moves a valve closure mechanism by the second pressure stored in the swell chamber by the expansion of the first sleeve.

11. The downhole assembly of claim 1, further comprising:

a first seal circumferentially surrounding a first end of the second sleeve, the first seal positioned between the first sleeve and the second sleeve at the first end of the second sleeve to prevent a flow of fluid from the swell chamber;

a second seal circumferentially surrounding a second end of the second sleeve, the second seal positioned between the first sleeve and the second sleeve at a second end of the second sleeve to prevent the flow of fluid from the swell chamber, the second seal having a larger cross sectional area exposed to the swell chamber than the first seal, the second sleeve movable in response to a force exerted on the first and second seals by the second pressure stored in the swell chamber, the downhole tool actuating in response to the movement of the second sleeve.

12. The downhole assembly of claim 1, further comprising:

a first seal circumferentially surrounding a first end of the second sleeve, the first seal positioned between the first sleeve and the second sleeve at the first end of the second sleeve to prevent a flow of fluid from the swell chamber;

a second seal circumferentially surrounding a second end of the second sleeve, the second seal positioned between the first sleeve and the second sleeve at a second end of the second sleeve to prevent the flow of fluid from the swell chamber, the second seal having a larger cross sectional area exposed to the swell chamber than the first seal, the second sleeve movable in response to a force exerted on the first and second seals by a third pressure outside of the swell chamber, the downhole tool actuating in response to the movement of the second sleeve.

13. A downhole assembly for a wellbore, the downhole assembly comprising:

a first sleeve expandable from a first position to a second position in response to a first pressure applied to the first sleeve and contractible to the first position in response to a cessation of the first pressure;

a second sleeve adjacent to the first sleeve, the first and second sleeves defining a swell chamber; and a sliding sleeve movable in response to a second pressure stored in the swell chamber by an expansion of the first sleeve.

14. The downhole assembly of claim 13, further comprising:

a first seal positioned between the first sleeve and the second sleeve at a first end of the second sleeve to prevent a flow of fluid from the swell chamber;

a second seal positioned between the first sleeve and the second sleeve at a second end of the second sleeve to prevent the flow of fluid from the swell chamber, the second sleeve movable in response to a force exerted on the first and second seals by the second pressure stored in the swell chamber, the sliding sleeve movable in response to the movement of the second sleeve.

15. The downhole assembly of claim 14, wherein the second seal has a larger cross-sectional area exposed to the swell chamber than the first seal.

16. The downhole assembly of claim 14, wherein the first seal comprises a first seal circumferentially surrounding a first end of the second sleeve and the second seal comprises a second seal circumferentially surrounding a second end of the second sleeve.

17. The downhole assembly of claim 13, further comprising a shifting mechanism operative to incrementally move the sliding sleeve in a single direction in response to the second pressure stored in the swell chamber.

18. The downhole assembly of claim 13, further comprising a metering mechanism.

19. A downhole assembly for a wellbore, the downhole assembly comprising:

a first sleeve expandable from a first position to a second position in response to a first pressure applied to the first sleeve and contractible to the first position in response to a cessation of the first pressure;

a second sleeve adjacent to the first sleeve the first and second sleeves defining a swell chamber; and a valve closure mechanism distinct from the first sleeve and movable in response to a second pressure that is stored in the swell chamber by an expansion of the first sleeve.

20. The downhole assembly of claim 19, further comprising a piston movable in response to the second pressure stored in the swell chamber, wherein the valve closure mechanism is movable in response to movement of the piston.

21. The downhole assembly of claim 20, wherein the piston is operable to move the valve closure mechanism between an open position and a closed position in response to the second pressure stored in the swell chamber and operable to move the valve closure mechanism toward the other of the open or the closed position in response to a pressure outside of the swell chamber.

* * * * *